United States Patent [19]

Parisi

[11] 4,068,398

[45] Jan. 17, 1978

[54] KNOCKDOWN SIGN ASSEMBLY

[75] Inventor: Dominick Parisi, Park Ridge, Ill.

[73] Assignee: Spanjer Brothers Inc., Chicago, Ill.

[21] Appl. No.: 698,485

[22] Filed: June 21, 1976

[51] Int. Cl.[2] ..... G09F 1/00

[52] U.S. Cl. ..... 40/607; 40/610

[58] Field of Search ..... 40/145 R, 125 H

[56] References Cited

U.S. PATENT DOCUMENTS

| | | | |
|---|---|---|---|
| 2,373,778 | 4/1945 | Quimby | 40/125 H |
| 2,865,124 | 12/1958 | Mortellito | 40/125 H |
| 2,872,750 | 2/1959 | Holcomb | 40/125 H |

FOREIGN PATENT DOCUMENTS

| | | | |
|---|---|---|---|
| 2,330,689 | 1/1975 | Germany | 40/145 |
| 276,547 | 1/1927 | United Kingdom | 40/145 |
| 1,167,238 | 10/1969 | United Kingdom | 40/145 |

*Primary Examiner*—Russell R. Kinsey
*Assistant Examiner*—Wenceslao J. Contreras
*Attorney, Agent, or Firm*—Rummler & Snow

[57] ABSTRACT

A knockdown advertising and display sign comprising a single setscrew for retaining a lockup cap which "buttons-up" the final assembly of the sign for simplifying set-ups and change of display panels and lowering manufacturing costs and for improving stability of the sign in the field by reducing its sensitivity to looseness of fit.

3 Claims, 5 Drawing Figures

KNOCKDOWN SIGN ASSEMBLY

BACKGROUND OF THE INVENTION

"Knockdown" assemblies used for sign construction in the advertising and sign display business involving prefabricated signboards for assembly with sign posts are invariably complex in construction, expensive to manufacture and hard to assemble. They have tended to lack structural stability after a time after installation due to dependence upon tightness and fit of the many fasteners used in their construction which have a tendency to work loose. This requires much maintenance.

There is an established need in the advertising and sign display business for a prefabricated sign construction which has a minimum of fasteners and a self-locking capability for "buttoning-up" the sign upon final asssembly which is not sensitive to looseness of fit.

SUMMARY OF THE INVENTION

The gist of this invention lies in a prefabricated sign assembly comprising a minimum of fasteners and a self-locking capability upon final assembly of parts. Two hollow posts are spaced one from the other for supporting the sign, each post of which carries a slot in each opposite-facing side-wall thereof to receive end-flanges of a panel for carrying the message installed therebetween. The panel end-flanges are each slotted at the bottom in an upwardly direction to slide over and lock on the bottom of each of the slots in the side-walls of each of the posts upon assembly therewith. A piloted cap having a peripheral shoulder inserts in each of the tops of the hollow posts for locking the sign panel in place. The panel flanges are each slotted at the top in a downwardly direction to form an upwardly-extending tongue member which inserts in and engages a matching groove in the bottom surface of the cap which is assembled therewith in the hollow end of the post. A single nonload-carrying setscrew for engaging the top end of the hollow post with the shoulder on the cap as inserted in the post "buttons-up" and the final assembly of the sign prevents accidental withdrawal of the cap therefrom.

DESCRIPTION OF THE PREFERRED EMBODIMENT

Figure 1:
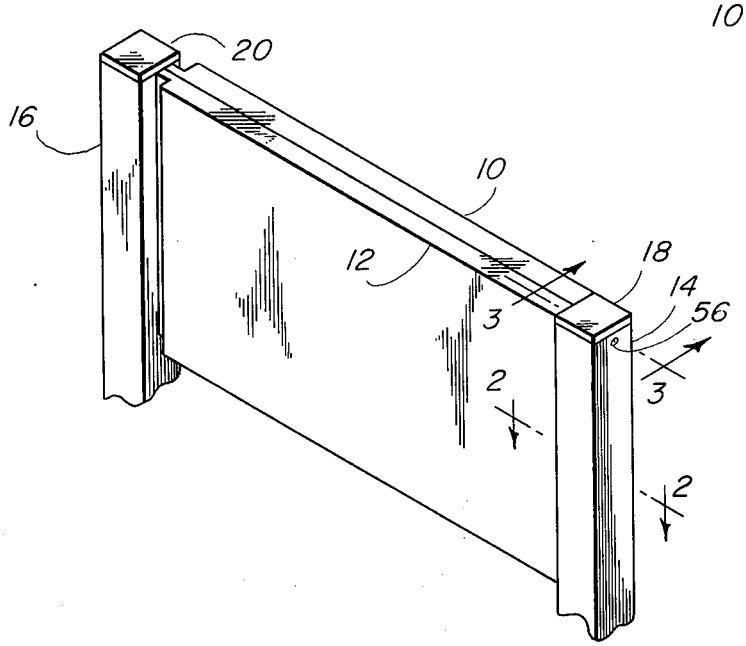
FIG. 1 shows a fragmentary perspective view of the lock-up cap prefabricated sign assembly of this invention.
Figure 2:
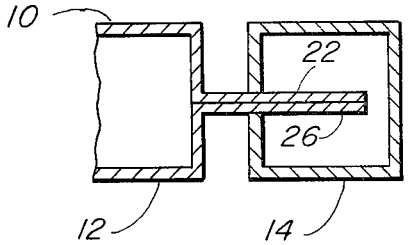
FIG. 2 shows a fragmentary cross-section along line 2—2 of FIG. 2.
Figure 5:
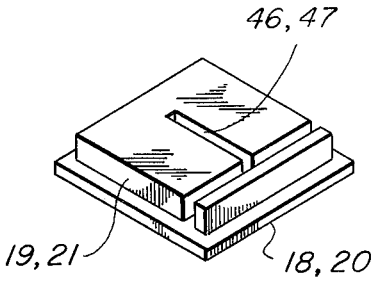
FIG. 5 shows a perspective view of the bottom of the locking-cap.
Figure 3:
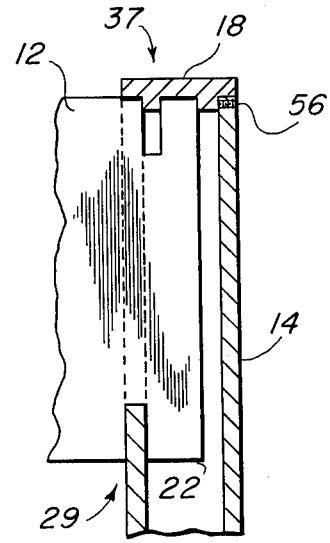
FIG. 3 shows a fragmentary cross-section along line 3—3 of FIG. 1.
Figure 4:
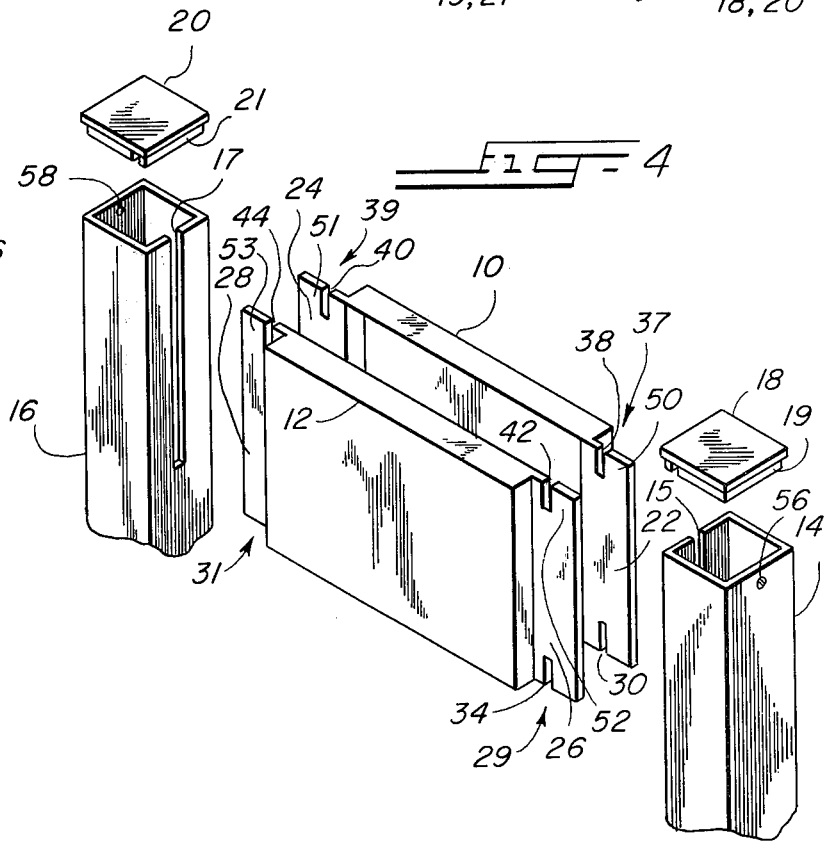
FIG. 4 shows a fragmentary exploded view of the parts of the sign assembly of FIG. 1.

Referring to FIG. 1, the lockup cap sign assembly comprises back-to-back sign panels 10 and 12 of rectangular shape which are assembled in end-to-end relation between right hand and left hand, horizontally spaced posts 14 and 16, each post having a hollow square cross-section with equal wall thickness all around, as shown in FIG. 2, and each post mounting on a base member (not shown), or as cast in a concrete block, or as driven into the ground, and extending upwardly in a vertical direction therefrom. Cap members 18 and 20, having pilots 11 and 13, respectively on the bottom surfaces thereof, and each inserting in the tops of each of the posts 14 and 16 up to the height of pilot shoulders 19 and 21 thereon, respectively, as shown in FIG. 3, pilot into and close-off the open tops of their respective posts 14 or 16 into which they are assembled for locking sign panels 10 and 12 into place between the posts 14 and 16. Rectangular slots 15 and 17 are milled in opposite-facing side-walls in each hollow post 14 and 16, respectively, extending downwardly in a vertical direction along the center line from and opening to the top thereof to bottom out below.

Rectangular flange members 22 and 24 and 26 and 28 each mount on opposite ends of panels 10 and 12, respectively, and extend therealong a distance which is somewhat greater than the distance that slots 15 and 17 are milled down the side wall of each post 14 and 16 from the top thereof. Bottom-panel slip-joint means 29 and 31 comprises slots 30 and 34 having widths slightly greater than the wall thickness of hollow posts 14 and 16, which are milled in the flanges 22 and 24 and 26 and 28, respectively, at a distance in from the longitudinal edge thereof which is less than the inside dimension of the hollow square cross-section of posts 14 and 16, respectively, the said slots opening to and extending upwardly in a vertical direction from the bottoms of the flanges by a distance such that when the flanges 22 and 24 and 26 and 28 are assembled in slots 15 and 17 of posts 14 and 16, respectively, the tops of flanges 22 and 24 and 26 and 28 will be in a flush relation with the tops of the posts 14 and 16, respectively.

Top-panel slip-joint means 37 and 39 comprises slots 38 and 40 and 42 and 44, also having widths which are slightly greater than the wall thickness of hollow posts 14 and 16, which are milled in the flanges 22 and 24 and 26 and 28, respectively, at a distance from the longitudinal edge thereof which is less than the distance slots 30 and 34 are milled in from the longitudinal edge of the flange by an amount at least the thickness of the wall of said posts 14 and 16, the slats 38, 40, 42 and 44 downwardly in a vertical direction from the tops of the said flanges by a distance which is greater than the height of the pilot shoulders 19 and 21 around each of the caps 18 and 20, respectively, forming rectangular tongue members 50 and 51 and 52 and 53 on flange members 22 and 24 and 26 and 28, respectively.

Rectangular grooves 46 and 47 having widths slightly greater than the thickness of the rectangular tongue members 50 and 51 and 52 and 53 taken together are milled in each of the bottom surfaces of each of the caps 18 and 20 along each of the centerlines thereof starting from the side of squaring-off cuts 43 and 45 at right angles thereto in from the shoulders 19 and 21 around said caps 18 and 20 by a distance which is slightly less than the wall thickness of posts 14 and 16, respectively, and extending in by a distance slightly greater than the breadth of tongues 50 and 51 and 52 and 53, respectively, and having a width which is slightly greater than the sum of the thicknesses of the flange members 22 and 26 and 28 and 30, respectively, and a depth which is greater than the height of shoulders 19 and 21, respectively.

Setscrews 56 and 58 each threadably engage through the wall of each of the posts 14 and 16, respectively, down from the top of either post 14 or 16 at a distance which is not greater than the height of the pilot shoulders 19 and 21, for bearing against said shoulders 19 and 21, respectively, when caps 18 and 20 are in place in the tops of posts 14 and 16, respectively, for "buttoning-up" the final assembly of the sign.

In the assembly of the lockup cap sign, the posts 14 and 16 are spaced and mounted in vertical orientation having slots 15 and 17, respectively, therein facing each other. Flange members 22 and 26 and 24 and 28 are placed in back-to-back relation matching slots 30 and 34, 38 and 42, 32 and 36, and 40 and 44, respectively, and flange members 22 and 26 are slid in and down slot 15 in post 14 and flange members 24 and 28 are slid in down slot 17 in post 16 until slots 30 and 34 in flanges 22 and 26 engage the bottom of slot 15 in post 14 and slots 32 and 36 engage the bottom of slot 17 in post 16.

Pilots 19 and 21 on the bottom surfaces of caps 18 and 20, respectively, are each inserted in tops of posts 14 and 16, respectively. Rectangular grooves 46 and 47 in the bottom surface of the caps 18 and 20 are orientated in the plane of the panels 10 and 12, as assembled in the sign, with the end of the groove 46 or 47 which is slightly less than one wall thickness of either post 14 or 16 distance from the pilot shoulder 19 or 21, respectively, orientated to the sides of either posts 14 and 16 which bear an opposite face-to-face relation with each other.

Although but one specific embodiment of this invention is herein shown and described, it will be understood that details of the construction shown may be altered or omitted without departing from the spring of the invention as defined by the following claims.

I claim:

1. In a knockdown sign assembly having posts which are hollow and open at the top and spaced a predetermined distance apart with a display panel having a flange at each end thereof for engaging each of said posts in support therebetween, the combination with said sign assembly of:

a. a bottomed slot in each of the mutually facing walls of said posts extending downwardly from and opening to the top thereof and engaging a respective one of the panel end flanges therein;

b. bottom slip-joint means comprising a slot at the bottom of each flange for engaging the wall of the respective post at the bottom of the bottomed slot therein, said slip-joint slot having a width slightly greater than the thickness of the post wall;

c. a cap for each post having a shouldered pilot inserting in each of the open tops thereof;

d. a top slip-joint means comprising a groove in the bottom surface of each of said caps engaging with a tongue at the top of each of said flange members; and e. a fastening means for securing the caps on their respective posts.

2. In the sign assembly as set forth in claim 1 wherein the top slip-joint means comprises a rectangular tongue member extendng upwardly at the top of each of said flanges, each tongue member inserting in a rectangular groove in the bottom surface of a respective one of said caps, said groove having a width slightly greater than the thickness of the rectangular tongue member inserted therein and said tongue member having its outer edge engaging the flat outer side of a squaring-off cut formed at one end of said groove at right angles thereto,

3. A knockdown sign assembly comprising back-to-back sign panels having rectangular shape assembling in end-to-end relation between right and left hand, horizontally spaced posts, each post having a hollow square cross-section with equal wall thickness all around; cap members each having pilots on the bottom surfaces thereof, and each inserting in the tops of each of the posts up to the height of pilot shoulders thereon to close off the open tops of said posts into which they are assembled for locking said panels into place between said posts; first rectangular slots in opposite side walls of each of said hollow posts extending downwardly and bottoming out below in vertical relation thereto along the center line from and open to the top thereof; rectangular flange members each mounting on opposite ends of said panels and extending therealong a distance slightly greater than the distance that said first slots extend down the side wall of each post from the top thereof; second slots each having a width slightly greater than the wall thickness of said hollow posts in said flanges extending upwardly in a vertical direction from the bottoms thereof a distance in from the end thereof slightly less than the inside dimension of the hollow square cross-section of said posts and open to the tops of the flanges as assembled in said first slots bear a flush relation with the tops of said posts; third slots also each having a width slightly greater than the wall thickness of said hollow posts in said flanges extending downwardly in a vertical direction from and opening to the tops thereof by a distance slightly greater than the height of the pilot shoulders around each of said caps a distance from the end thereof slightly less than the distance said second slots extend in from the end thereof by the thickness of the wall of said posts; rectangular grooves in each of the bottom surfaces of each of said caps along each of the center lines thereof, starting in from the pilot shoulders around said caps by a distance slightly less than the wall thickness of said posts and having widths slightly greater than the thickness of each of said rectangular tongue members, and extending in by a distance slightly greater than the breadth of said tongues and having a width slightly greater than the sum of the thicknesses of the flange members and a depth slightly greater than the height of said pilot shoulders thereon; set-screws each threadably engaged through each wall of each of said posts at a distance down from the top thereof a distance not greater than the height of the pilot shoulders bearing against said shoulders with caps in place in the tops of said posts.

* * * * *